US006514920B1

(12) United States Patent
Katsuragi et al.

(10) Patent No.: US 6,514,920 B1
(45) Date of Patent: Feb. 4, 2003

(54) LIQUID COMPOSITION, METHOD OF CLEANING INK-JET RECORDING HEAD, INK-JET RECORDING APPARATUS, CARTRIDGE, AND METHOD OF REGENERATING INK-JET RECORDING HEAD

(75) Inventors: Ryuji Katsuragi, Tokyo (JP); Makoto Shioya, Tokyo (JP); Hideto Yokoi, Yokohama (JP); Masataka Eida, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/584,737

(22) Filed: Jun. 1, 2000

(30) Foreign Application Priority Data

Jun. 3, 1999 (JP) ..... 11-156702

(51) Int. Cl.[7] ..... C11D 9/00; C11D 9/02; C11D 9/04

(52) U.S. Cl. ..... 510/170

(58) Field of Search ..... 510/170

(56) References Cited

U.S. PATENT DOCUMENTS

| | | | | |
|---|---|---|---|---|
| 4,929,964 | A | 5/1990 | Sato et al. | 347/62 |
| 5,062,892 | A | 11/1991 | Halko | 106/22 |
| 5,108,501 | A | 4/1992 | Moffatt | 106/20 |
| 5,451,251 | A | 9/1995 | Mafune et al. | 106/22 H |
| 5,462,590 | A | 10/1995 | Yui et al. | 106/20 |
| 5,825,380 | A | 10/1998 | Ichizawa et al. | 347/28 |

FOREIGN PATENT DOCUMENTS

| | | |
|---|---|---|
| JP | 54-051837 | 4/1979 |
| JP | 2-078554 | 3/1990 |
| JP | 3-160070 | 7/1991 |
| JP | 5-194888 | 8/1993 |
| JP | 6-220386 | 8/1993 |
| JP | 9-39260 | 2/1997 |

*Primary Examiner*—Yogendra N. Gupta
*Assistant Examiner*—John M Petruncio
(74) *Attorney, Agent, or Firm*—Fitzpatrick, Cella, Harper & Scinto

(57) ABSTRACT

A liquid composition for cleaning an ink-jet recording head containing at least one kind of oxidizing detergent in an amount effective in cleaning an ink-jet recording head. The liquid composition can improve the life and ink ejecting properties of an ink-jet recording head.

2 Claims, 5 Drawing Sheets

LIQUID COMPOSITION, METHOD OF CLEANING INK-JET RECORDING HEAD, INK-JET RECORDING APPARATUS, CARTRIDGE, AND METHOD OF REGENERATING INK-JET RECORDING HEAD

BACKGROUND OF THE INVENTION

1. Field of the Invention

This invention relates to a liquid composition, a method of cleaning an ink-jet recording head, an ink-jet recording apparatus, an ink cartridge, and a method of regenerating an ink-jet recording head.

2. Related Background Art

Various ink-jet recording methods have been proposed, and among them, the ink-jet recording method described in Japanese Laid-Open Patent Application No. 54-51837 etc., the so-called bubble-jet recording method, utilizes thermal energy for ejecting ink as ink droplets. The features of this method are that a high density multi-nozzle system can be easily set up, it can provide high quality images at a high speed and at a very low cost, and it enables printing on plain paper having no special coating.

The recording method known as the bubble-jet recording method carries out recording as follows: a bubble is generated in the ink on the heater of the recording head by rapid heating of the heater, and by the action of the bubble inflating rapidly in volume, an ink droplet is ejected from a nozzle located at the top of the recording head and it flies and attaches to the recording paper for recording.

In the above bubble ink jet recording method, however, the heater in the recording head is repeatedly heated for ink ejection, and when a large amount of recording is carried out, the decomposition products of the ink (so-called "koga") will be deposited on the surface of the heater. Deposition of koga (so-called "kogation") prevents efficient thermal energy transfer to the ink, which may lead to a decrease in the volume and flying speed of the ejected ink droplet in comparison with those at the beginning, or even in stoppage in ejection. Thus, reduction of the kogation on the heater has been sought and various ink formulations have been proposed to improve the life of the bubble-jet recording head. There have been proposed various methods; for example, methods to decrease the amount of impurities in the ink or dye, methods to modify the ink formulation, e.g., inks containing oxoanions (Japanese Laid-Open Patent Application No. 3-160070), bile acid salts (Japanese Laid-Open Patent Application No. 5-194888), and an amine compound of a specified formula (Japanese Laid-Open Patent Application No. 6-220386). However, kogation may occur and lead to poor ejection after a long use of the printer, for example, after a number of renewals of the ink container of a printer in which the ink container and the recording head are separated. Also, it is difficult to recover the used cartridges from the recording heads in a recycling plant.

Japanese Laid-Open Patent Application No. 9-39260 discloses a method to clean the heating head of an ink-jet recording apparatus with a liquid containing water and a surfactant, which liquid, the inventors of the present invention have found out, is not adequate to completely remove the koga deposited on the heater of the recording head.

On the other hand, the heater surfaces of newly produced ink-jet recording heads are often soiled through the various manufacturing processes, which leads to unstable ink ejection at the beginning of usage. To solve this problem, for example, Japanese Laid-Open Patent Application No. 2-78554 discloses to carry out an aging treatment for steady ink ejection. The aging treatment, however, may result in kogation on the heater surface, which reduces the ejection volume, and prevents full exhibition of the intrinsic performance of the head, even at the very beginning of usage. Considering the technical background and the present inventors' study as above, as well as the increasing worldwide requirement for resource recycling, the inventors of the present invention have come to acknowledge a need of developing superior methods for removal of the deposit on the heater surface of the ink-jet recording head.

SUMMARY OF THE INVENTION

Accordingly, an object of the present invention is to solve the aforementioned problems, in particular, to provide a liquid composition, for use in an ink-jet recording head utilizing thermal energy, which is capable of cleaning/removing koga or soil deposited on the heater surface of an ink-jet recording head after long usage or during its manufacturing processes, and hence improving the life and ejection characteristics of the ink-jet recording head.

Another object of the present invention is to provide a method of cleaning an ink-jet recording head which enables the improvement in the life and ink ejection characteristics of the above ink-jet recording head by cleaning/removing koga or soil deposited thereon, in addition, an ink-jet recording apparatus utilizing the above liquid composition and containing means of performing the above cleaning method.

Further, another object of the present invention is to provide a cartridge which enables a more excellent cleaning of an ink-jet recording head as well as an efficient and easy regeneration of the ink-jet recording head.

Still another object of the present invention is to provide a method of regenerating an ink-jet recording head which enables the reuse of the ink-jet recording head having been used for ejecting ink-jet ink and having deposits on its heater surface as a new ink-jet recording head used for the ink-jet recording of high quality images.

According to one aspect of the present invention, there is provided a liquid composition which contains a detergent in an amount effective in cleaning a portion of an ink-jet recording head.

According to another aspect of the present invention, there is provided a liquid composition for use to remove deposit on a surface of a heater of an ink-jet recording head wherein the recording head is used for ejecting an ink containing a coloring material and the surface of the heater is a protective layer comprising a metal or metal oxide or both; where the liquid composition is capable of oxidizing and decomposing the deposit when thermal energy is applied to the heater having the deposit and being in contact with the liquid composition.

According to still another aspect of the present invention, there is provided a method of cleaning an ink-Jet recording head using the liquid composition which contains at least one detergent in an amount effective in cleaning a portion of the ink-jet recording head.

According to still another aspect of the present invention, there is provided an ink-jet recording apparatus, which comprises a liquid container containing a liquid composition which contains a detergent in an amount effective in cleaning an ink-jet recording head; an ink container containing an ink; valve means for selecting one of the liquid composition and the ink to supply it to an ink-jet recording head; and an ink-jet recording head.

According to still another aspect of the present invention, there is provided a cartridge for use in cleaning of an ink-jet recording head having a heater of which a surface is coated with a protective layer which comprises a metal or a metal oxide or both, the cartridge containing a liquid composition comprising a compound having an oxidizing ability; and the cartridge being in a configuration detachable from the recording head.

According to still another aspect of the present invention, there is provided a method of regenerating an ink-jet recording head for ejection of an ink containing a coloring material wherein the head has a heater of which a surface is coated with a protective layer which comprises a metal or a metal oxide or both; the method comprises a step of applying thermal energy to the heater being in contact with a liquid composition, wherein the liquid composition contains a compound having an oxidizing ability.

DETAILED DESCRIPTION OF THE PREFERRED INVENTION

Figure 1:
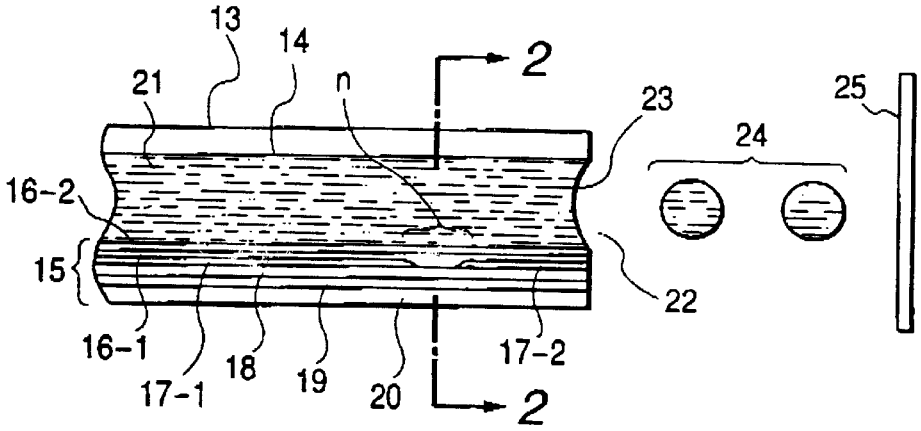
FIG. 1 is a longitudinal sectional view of one form of recording head of an ink-jet recording apparatus according to the present invention.

The present invention is described in further detail with reference to preferred embodiments.

First, a detergent contained in a liquid composition of the present invention is preferably a compound having an oxidizing activity. The reason why the oxidizing compound can clean and remove koga or soil on the heater surface is considered to be as follows: when the compound generates foam on the heater surface, the koga or soil deposited on the surface of the heater is subjected to oxidative decomposition, and is cleaned and removed with the impact of forming and breaking of the foam. Thus the surface of the heater is restored to the initial state, and the ink-ejecting properties, having been unstable due to the koga or soil on the heater surface, are restored.

The oxidizing compounds as described above include, for example, hydrogen peroxide, sodium percarbonate, peroxyhydrate of sodium carbonate, sodium perborate, sodium peroxide, sodium periodate, sodium hypochlorite, sodium perchlorate, sodium persulfate and peracetic acid, where hydrogen peroxide is particularly preferable. The content of the detergent is preferably in the range of 0.05 to 40 wt %, more preferably 0.3 to 10 wt % of the total weight of the liquid composition.

The liquid composition of the present invention is usually prepared by blending water with the above detergent. Preferably, deionized water, not ordinary water containing various ions, is used. The content of water is preferably in the range of 60 to 99.95 wt % of the total weight of the liquid composition.

The liquid composition of the present invention made of the above detergent and water may also contain a water-soluble organic solvent to control the viscosity and surface tension desirable for practical use, and to ensure stable foaming of the composition.

The concrete examples of the above solvent include, for example, alkyl alcohols having 1 to 5 carbons such as methyl alcohol, ethyl alcohol, n-propyl alcohol, isopropyl alcohol, n-butyl alcohol, sec-butyl alcohol, tert-butyl alcohol, isobutyl alcohol and n-pentanol; amides such as dimethylformamide and dimethylacetamide; ketones or keto alcohols such as acetone, methyl ethyl ketone, methyl isobutyl ketone and diacetone alcohol; ethers such as tetrahydrofuran and dioxane; oxyethylene or oxypropylene copolymers such as diethylene glycol, triethylene glycol, tetraethylene glycol, dipropylene glycol, tripropylene glycol, polyethylene glycol and polypropylene glycol; alkylene glycols of which alkylene group includes 2 to 6 carbons, such as ethylene glycol, propylene glycol, trimethylene glycol and triethylene glycol; polyols such as 1,2,6-hexantriol, glycerol, trimethylolethane, trimethylolpropane; lower alkyl ethers such as ethylene glycol monomethyl (or monoethyl) ether and diethylene glycol monomethyl (or monoethyl) ether and triethylene glycol monomethyl (or monoethyl) ether; lower dialkyl ethers of polyhydric alcohol, such as triethylene glycol dimethyl (or ethyl) ether and tetraethylene glycol dimethyl (or ethyl) ether; alkanolamines such as monoethanolamine, diethanolamine and triethanolamine; sulfolane, N-methyl-2-pyrrolidone, 2-pyrrolidone, and 1,3-dimethyl-2-imidazolydinone. The above water-soluble organic solvents can be used solely or as a mixture of two or more solvents.

In addition to the above ingredients, various types of widely known additives, for example, pH regulator, viscosity modifier, antimold, antiseptic, antioxidant, antifoamer, surfactant, antidrying agent such as urea can be added to the liquid composition of the present invention, according to the situation.

The aforementioned liquid composition of the present invention is used for cleaning an ink-jet recording head.

Next, a method of cleaning an Ink-jet recording head using the above liquid composition is described. There are two types of ink-jet recording methods in current use. One is to eject ink droplets by applying mechanical energy to the ink. The other is to eject each ink droplet by the action of a bubble generated in the ink by thermal energy applied to the ink. The liquid composition of the present invention can be used for cleaning both types of the ink-jet recording heads, but it is most effective to use the composition for cleaning the ink-jet head of the latter thermal type. In the following, is described with reference to the drawings a recording head cleaning method for a recording apparatus equipped with an ink-jet recording head in which thermal energy is applied to ink to eject the ink in the form of ink droplets.

Figure 2:
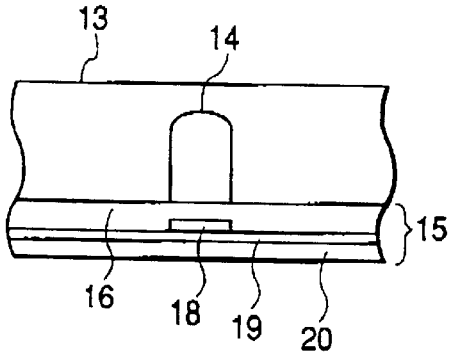
FIG. 2 is a transverse sectional view of one form of recording head of an ink-jet recording apparatus according to the present invention.

FIGS. 1 and 2 illustrate one example of recording head constructions, equipped in an ink-jet recording apparatus, the so called "bubble jet" recording apparatus. The ink-jet recording head (hereinafter sometimes referred to simply as "recording head") in which thermal energy is applied to ink to eject the ink in the form of ink droplets, is the main part of the recording apparatus.

FIG. 1 is a sectional view of a recording head 13 taken substantially along the ink flow path, and FIG. 2 is a sectional view of the head 13 taken on line 2—2 of FIG. 1. The recording head 13 is produced by bonding a glass, ceramic, silicon, polysulfone or plastic plate provided with an ink flow path (nozzle) 14 to a substrate 15 with a heat generating element. The substrate 15 consists of a protective layer 16-1 made of silicon oxide, silicon nitride or silicon carbide; an uppermost protective layer 16-2 made of a metal such as platinum, a metal oxide such as platinum oxide, preferably of tantalum or tantalum oxide; electrodes 17-1 and 17-2 made of aluminum, gold or aluminum-copper alloy; a heat generating resistance layer 18 made of a high melting point material such as hafnium boride, tantalum nitride or tantalum-aluminum; a heat storage layer 19 made of silicon oxide or aluminum oxide and a substrate 20 made of a heat dissipating material such as silicon, aluminum or aluminum nitride.

Figure 3:
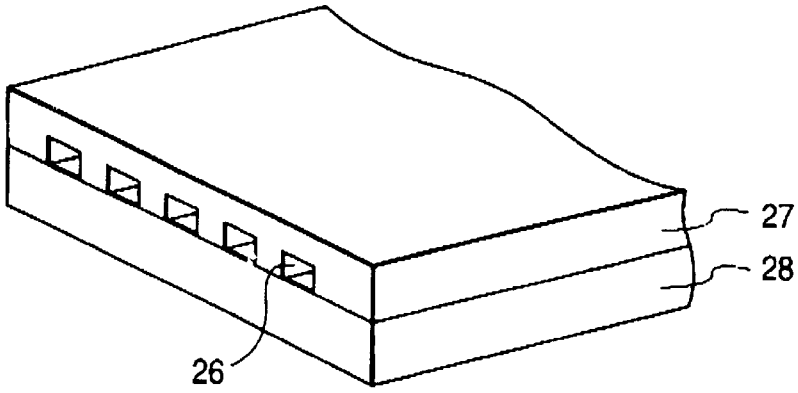
FIG. 3 shows an external appearance in perspective of a head comprised of multiple heads shown in FIG. 1.

The operation of the recording head 13 shown in FIG. 1 is as follows: When an electronic pulse signal is applied to the electrodes 17-1 and 17-2 of the recording head 13, a heater region designated by n of the substrate 15 rapidly generates heat to generate a bubble in ink 21 where it is in contact with the surface of the region n, a meniscus 23 is protruded by the pressure of the bubble, the ink 21 is ejected in the form of a small droplet 24 from an ejection orifice 22 and the droplet flies toward a recording paper 25. FIG. 3 illustrates the external appearance of one example of a multi-head in which a plurality of the heads shown in FIG. 1 are arranged. This multi-head is produced by bonding a glass plate 27 provided with a plurality of nozzles 26 therein to a heat generating member 28 similar to the substrate 15 in FIG. 1.

Figure 4:
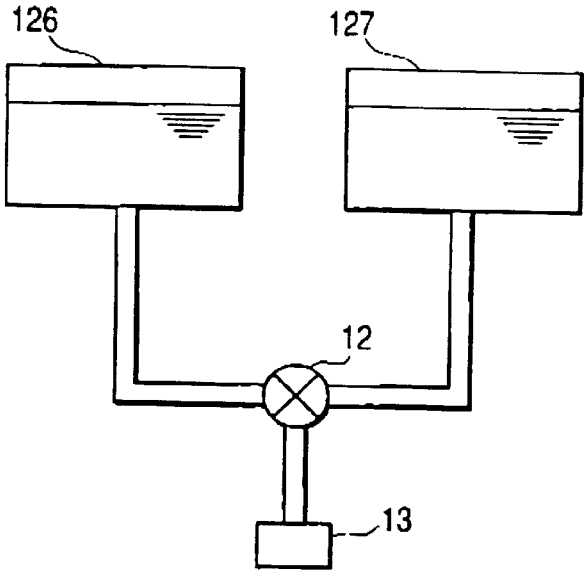
FIG. 4 is a schematic illustration of a path of ink and liquid composition in an ink-jet recording apparatus according to the present invention.

Next, an ink-jet recording apparatus equipped with a recording head shown in FIG. 1 is described. FIG. 4 illustrates a schematic view of a path for the ink and the liquid composition of the present invention in the ink-jet recording apparatus. A diverter valve 12 can choose the ink 126 or the liquid composition 127 of the present invention to feed to the recording head 13. When printing is carried out with ink, the ink 126 is fed to the recording head 13 by switching the diverter valve 12 to the ink side. When a large amount of printing was carried out resulting in kogation on the heater surface of the head 13 with unstable ejection properties such as smaller ejection amount, the diverter valve 12 is switched to the liquid composition side so that the liquid composition 127 is fed to the recording head 13 to clean the heater surface thereof.

With a newly produced recording head 13, ink ejection properties may be unstable since the surface of the heater or inside of the nozzle are often soiled in various manufacturing processes. In this case, too, the liquid composition 127 is fed to the recording head 13 to clean the heater surface, thereby the ink ejecting properties can be stabilized.

In order to clean the heater surface, the composition 127 is ejected from the recording head 13 for preferably $1\times10^2$ to $1\times10^7$ pulses, more preferably $1\times10^3$ to $5\times10^6$ pulses, by the ink-jet method. After cleaning of the heater surface with the liquid composition, the diverter valve 12 is again switched to the ink side so that the ink 126 is fed to the recording head 13 for printing. After that, cleaning is repeated in the same manner whenever the ink ejecting properties become unstable.

More particularly, the cleaning method of the present invention may include the following modifications; cleaning is carried out by the user of the recording apparatus at certain time intervals or at every certain printing amount to remove the koga on the heater surface; the apparatus is provided with a special switch or sequence for removing the koga on the heater surface and the user starts or drives it; or the ink jet recording apparatus automatically identifies the cartridge storing the cleaning liquid composition to drive it.

Now an ink-jet apparatus of the present invention is described.

Figure 5:
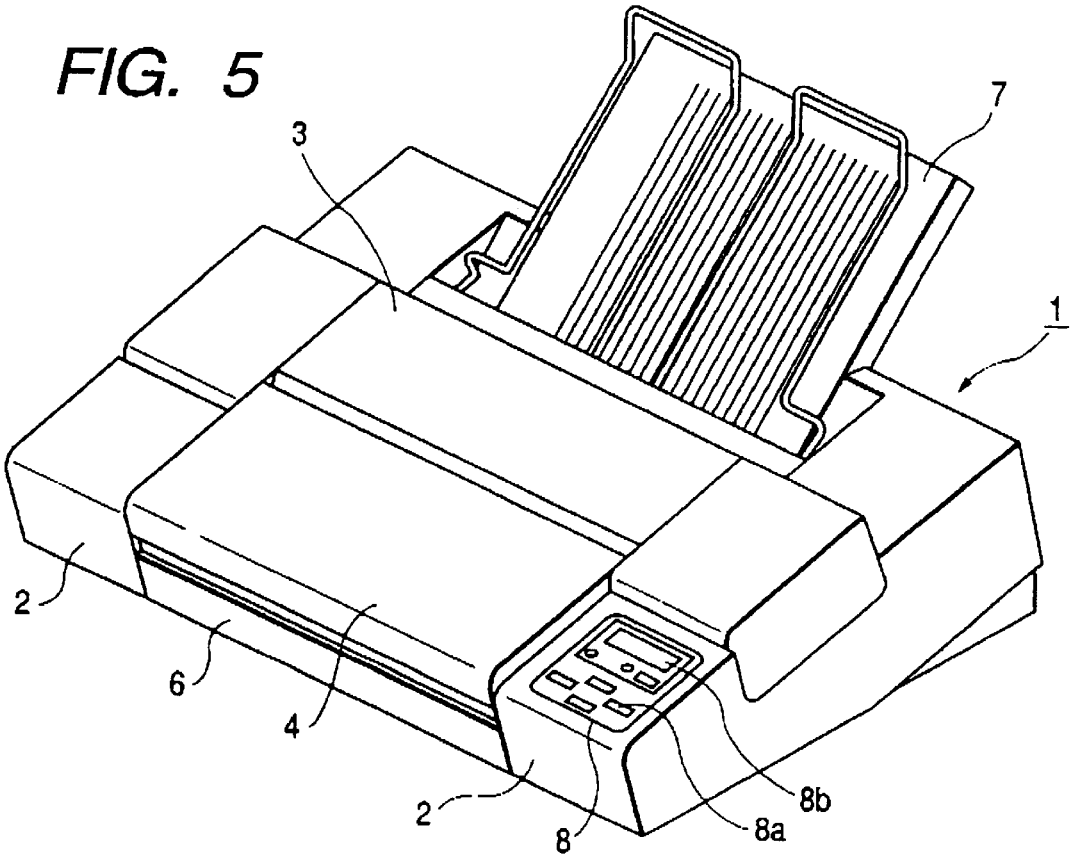
FIG. 5 shows an external appearance in perspective of one example of an ink-jet recording apparatus according to the present invention.
Figure 6:
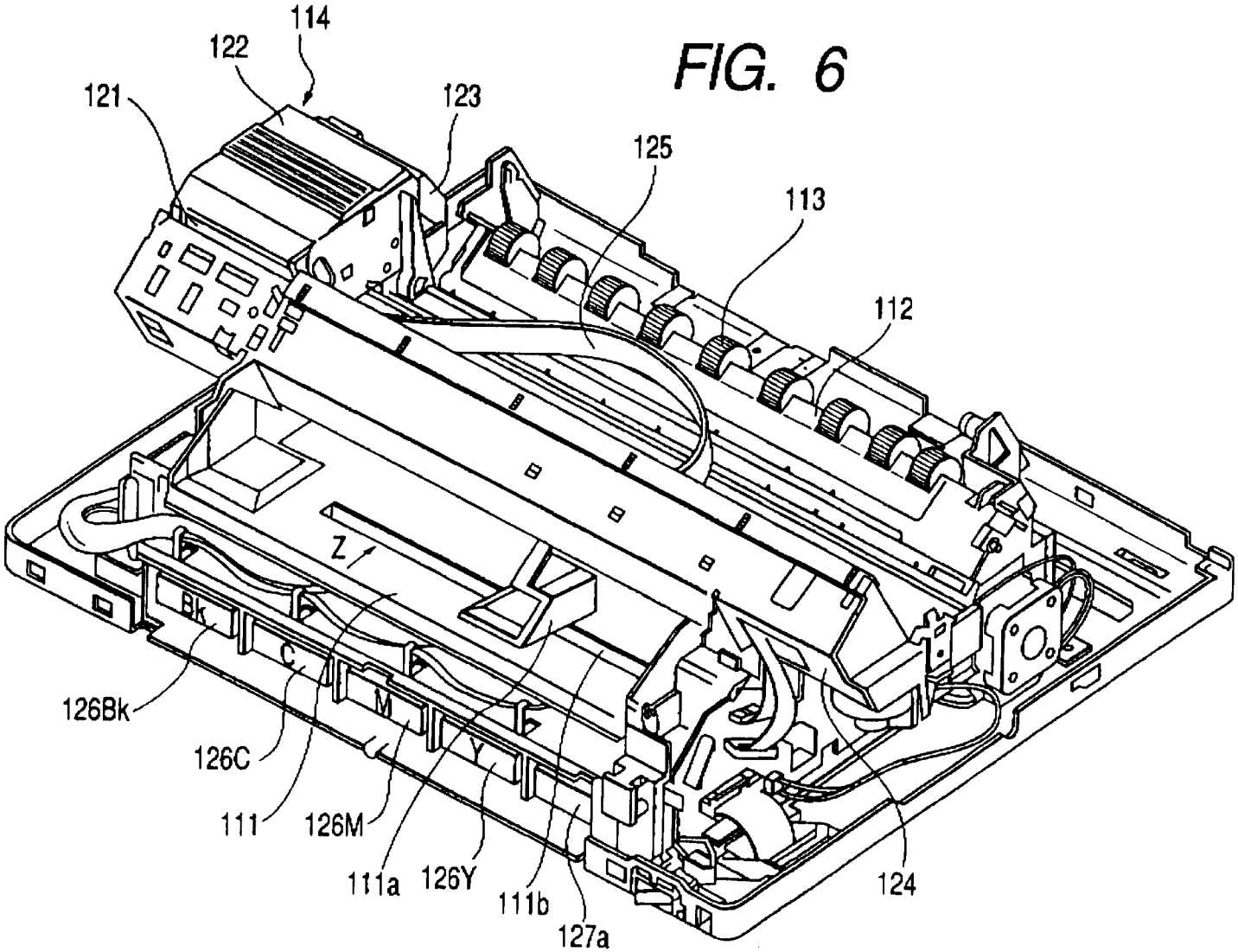
FIG. 6 is a view in perspective to show the interior construction of the ink-jet recording apparatus shown in FIG. 5.
Figure 7:
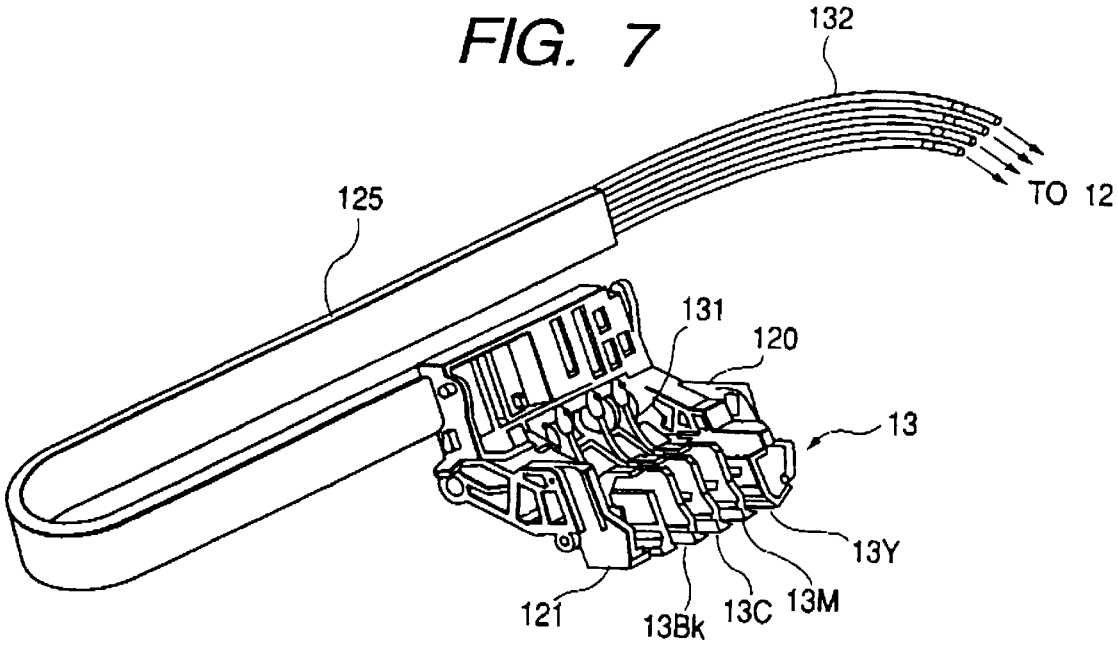
FIG. 7 is a view in perspective to show the construction of a head carriage and a tube unit of the ink-jet recording apparatus shown in FIG. 5.
Figure 8:
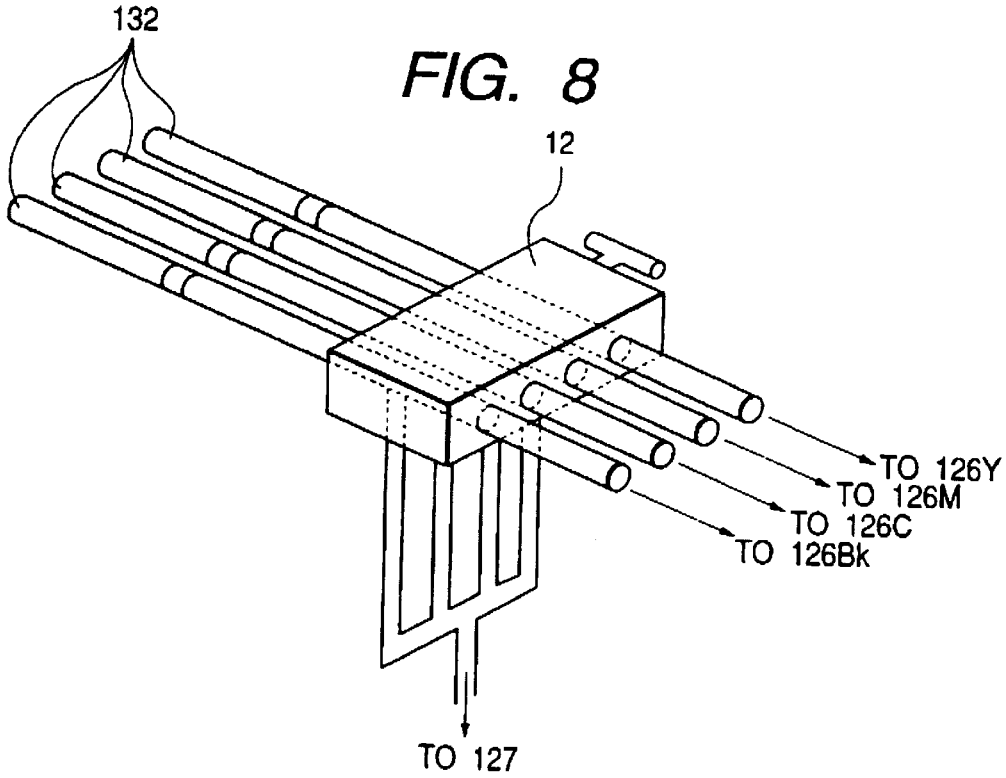
FIG. 8 is an external appearance in perspective to show the fitting state of tube members and a diverter valve member in the ink-jet recording apparatus shown in FIG. 5.
Figure 9:
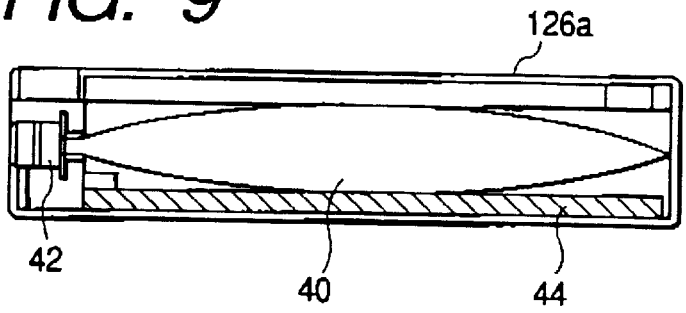
FIG. 9 is a view in perspective to show the interior construction of one form of ink cartridge of the ink-jet recording apparatus shown in FIG. 5.

Referring to the drawings, FIG. 5 is an external appearance in perspective of an ink-jet recording apparatus, FIG. 6 is a view in perspective to show the interior construction of the above ink-jet recording apparatus, FIG. 7 is a view in perspective to show the construction of a head carriage and a tube unit, FIG. 8 is a view in perspective to show the construction of the fitting portion of tube members on a diverter valve member, and FIG. 9 is a view to show the interior construction of an ink cartridge.

Referring particularly to FIG. 5, reference numeral 1 denotes an ink-jet recording apparatus (hereinafter referred to as "apparatus"), and numeral 2 denotes a main case, which forms part of the case of the apparatus 1 (hereinafter referred to as "case") and which is fixed to part of the frame of the apparatus 1, and covers both side parts of the apparatus 1, in other words, covers the apparatus 1 other than the portion corresponding to the width of a carrying path through which recording paper is conveyed. In one of the side portions of the apparatus, the home position of a recording head is set. The recording head stays at this home position when no recording is carried out, where an ejection recovery unit is also present to cap the ink ejection orifice of the recording head. The main case 2 covers the above recording head and ejection unit both. This protects the recording head and the ejection recovery unit from being touched inadvertently during maintenance or inspection of the apparatus with opened case, and consequently, prevents displacement or damage of the recording head and the ejection recovery unit.

Reference numeral 3 denotes a center case which also forms part of the case and covers the portion where the recording head travels during recording. This center case 3 is provided in an easily removable way. A spur is attached to a part of the center case corresponding to a paper discharge roller described later. Installation of the center case 3 allows the spur to contact with the paper discharge roller with a proper pressure. Reference numeral 4 denotes a paper feed lid which forms a part of the case and is provided in such a manner as to be freely opened and closed. This paper feed lid 4, which is rectangular as seen in FIG. 5, is supported by shafts at both ends of the front side in the figure, so that it can be opened in a rotating motion on the shafts and can be held at a predetermined angle.

The paper feed lid 4 and a paper feed tray, which is described later, are approximately in the same plane when the paper feed lid is held at the angle, and in this condition recording paper can be placed on it. Reference numeral 6 denotes an ink lid which forms a part of the case provided on the front side of the apparatus. This ink lid 6 is rotatingly supported by shafts provided at the lower part of the front side of the apparatus, which enables the ink lid 6 to be opened rotationally toward the front side on necessary occasion for attaching or detaching an ink cartridge in the apparatus.

Reference numeral 7 denotes a paper output tray which is detachably fitted to the apparatus 1. The output tray 7 is fitted at the rear portion of the apparatus 1 at a predetermined angle, and sheets of printed paper can be successively piled on it. Reference numeral 8 denotes an operation area provided on the front part of the main case 2. This operation area 8 contains a display portion 8*b* for displaying, for example, the state of the apparatus 1 and a key 8*a* for entering various commands to the apparatus 1.

Referring now to FIG. 6, reference numeral 111 denotes a paper feed tray which forms a paper feed portion together with the paper feed lid 4 shown in FIG. 5 (not shown in FIG. 6) when the paper feed lid 4 is opened. Recording paper is put on the paper feed tray 111 and conveyed in the direction of the arrow Z shown in the figure by a sheet feed roller (not shown). In this sheet feeding mechanism, reference numeral 111*a* denotes a guide plate for guiding sheets according to the size of the recording paper, and numeral 111*b* denotes a groove along which the guide plate 111*a* moves according to the size of the recording paper. Hereinafter, the recording paper shall include media, in a broader sense, subjected to recording, such as plastic sheets.

Reference numeral 112 denotes a platen for regulating the recording side of the recording paper, which is placed downstream in the paper path compared with a carrying roller etc., and on the opposite side of a recording head described later. On the further downstream side of the platen 112, provided is a paper discharge roller 113 which is rotated by a motor not shown in the figure and delivers the recording paper having been subjected to recording to the output tray 7 shown in FIG. 5 by cooperating with the spur held by the center case 3 shown in FIG. 5

Reference numeral 114 denotes a recording head portion which contains four recording head chips each of which corresponds to each different ink color, as illustrated in detail in FIG. 7. These recording head chips are fitted to a carriage body 121 of a carriage portion 120 (see FIG. 7) in a detachable manner. Reference numeral 122 denotes a carriage cover and numeral 123 a head cover. When these covers are fitted to the carriage body 121, the carriage body is electrically connected to the above recording head chips and the above chips are positioned or fixed. On a part of the carriage body 121 is placed a sub-tank for ink (not shown). The sub-tank can trap air bubbles in the ink-supplying system, and can buffer the pressure fluctuation in the ink-supplying system due to the movement of the carriage, protecting the recording head from the influence of air bubbles or pressure fluctuation.

Reference numeral 124 denotes a cover fixed to the apparatus frame to protect, for example, an ink supplying tube unit 125 moving with the moving carriage portion 120 and flexible cables (not shown). Reference numerals 126Bk, 126C, 126M and 126Y denote ink cartridges installed in the ink-supplying unit. Each ink cartridge houses an ink bag for storing black ink (Bk), cyan ink (C), magenta ink (M) or yellow ink (Y) and a waste ink bag for storing the discharged ink by suction during ejection recovery treatment. Reference numeral 127*a* denotes a liquid composition cartridge installed in the ink-supplying unit, which houses a bag for storing a liquid composition of the present invention and a bag for waste liquid composition for storing the discharged liquid composition by suction during ejection recovery treatment.

Referring to FIG. 7, there are shown recording head chips corresponding to the four color inks (the carriage cover 122 and the head cover 123 are detached). Recording head chips 13 are accurately positioned at predetermined locations of the carriage body 121 (in the figure, they are denoted as 13Bk, 13C, 13M and 13Y, respectively, according to the color) on installation. Installation makes a constitution which allows the electrical connection to transmit signals to the recording head 13, as well as ink-supply. Reference numeral 131 denotes a tube member (hereinafter referred to as "tube") for supplying ink to the recording head 13 from the ink sub-tank, and reference numeral 132 a tube for supplying ink to the ink sub-tank from the ink cartridge 126*a*. As the tube material, polyethylene resin is suitable; and if a thin-wall tube is used, the conditions of the ink inside the tube become visible because such a tube is translucent.

Referring to FIG. 8, there is shown an external appearance in perspective of the fitting portion of tube members and a diverter valve member. A diverter valve 12 is used as means for switching between ink and the liquid composition. Desirably, a valve mechanism is arranged between the sub-tank located in the recording head 13 and the common liquid chamber of the recording head 13. The reason is as follows: generally, a sub-tank is designed to have an ink capacity of about 3 to 10 ml, while the common liquid chamber of the recording head has an ink capacity of about 0.3 to 0.5 ml. Accordingly, when the liquid composition of the present invention replaces the ink in the sub-tank as well, the amount of ink loss is quite large in comparison with the case where only ink in the common liquid chamber is replaced. Thus, it is more advantageous, in terms of the amount of the ink disposed of and the time required for the disposal and refill of the ink, that the liquid composition of the present invention should be supplied to the recording head only, not to the sub-tank.

Specifically, for example, a two-way valve may be provided between the sub-tank and the common liquid chamber, or an on-off valve may be provided in combination with a check valve. When a two-way valve is used, the two-way valve is usually switched to the ink side so as to form an ink flow path, and when the liquid composition of the present invention is needed, it is switched so as to form a passageway to supply the liquid composition exclusively to the common liquid chamber of the recording head 13. In such a manner, the liquid composition is never supplied to the sub-tank side and never mixed with the ink in the sub-tank. Thus, there arises no need to dispose of the ink in the sub-tank and replace it with new ink.

When an on-off valve is used in combination with a check valve, the check valve is formed by thermally welding a thin polyethylene film to the inner wall of the ink flow path with a partly not-welded portion. As a result, ink flows in one direction, but never flows in the opposite direction. A pipe for supplying the liquid composition of the present invention is connected from the side of the main flow path at a position away from the check valve toward the common liquid chamber. Adjacent to the pipe, is disposed an on-off valve whose opening and closing function control the supply of the liquid composition of the present invention.

Thus, when opening the on-off valve and supplying the liquid composition under a higher pressure, by about 0.3 atm., than the pressure under which ink is normally supplied. The liquid composition does not flow toward the sub-tank, but toward the common liquid chamber of the recording head 13 due to the check valve. Under this operation, the ink in the common liquid chamber is extruded from the recording head 13 due to the higher pressure of the liquid composition, to be replaced by the liquid composition. After a predetermined amount of liquid composition is supplied, the on-off valve is closed, and a predetermined cleaning operation should be carried out under these conditions. After the cleaning of the recording head 13 with the liquid composition is completed, ink is supplied to the common liquid chamber as usual by means of suction recovery or feeding under pressure.

Referring to FIG. 9, there is shown a view of the interior construction of one example of ink cartridge 126*a* which houses the ink to be supplied to the recording head 13 through a tube. Reference numeral 40 denotes an ink-storing portion, such as an ink bag, for storing the ink for supply. On the tip of the ink-storing portion, a rubber stopper 42 is provided. Insertion of a needle (not shown) into the stopper 42 allows the ink stored in the ink bag 40 to be supplied to the recording head 13. Reference numeral 44 denotes an ink-absorber for receiving waste ink. Preferably the wetted surface of the ink-storing portion is made from polyolefin, more preferably polyethylene.

Figure 10:
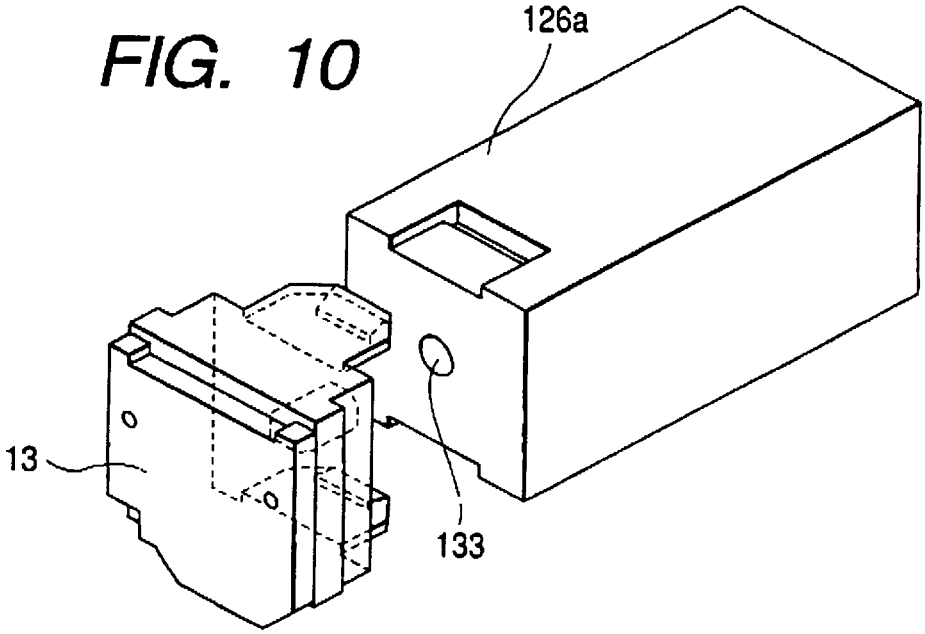
FIG. 10 is a view in perspective to show one form of construction of a recording head and an ink cartridge of the ink-jet recording apparatus according to the present invention.
Figure 11:
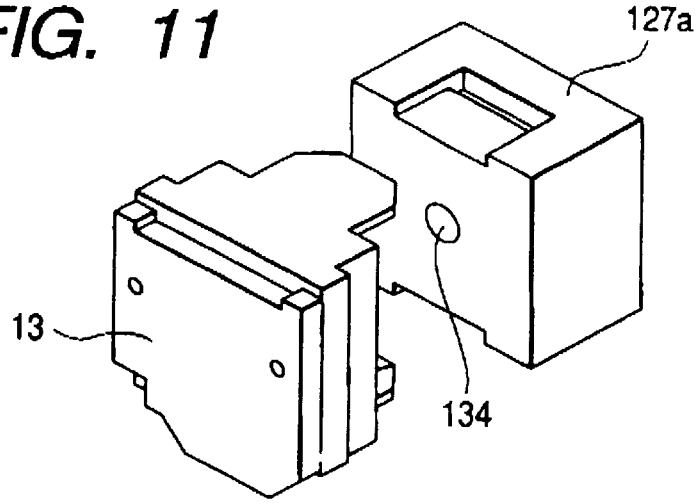
FIG. 11 is a view in perspective to show one example of construction of a recording head and a liquid composition cartridge of the ink-jet recording apparatus according to the present invention.

Alternatively, the ink-jet recording apparatus may be constructed in such a manner that the ink cartridge 126*a* and the recording head 13 can be freely detached from each other as shown in FIG. 10. Reference numeral 133 of FIG. 10 denotes an ink-supplying port provided for supplying the ink in the ink cartridge 126*a* to the recording head 13. Reference numeral 134 of FIG. 11 denotes a liquid composition-supplying port provided for supplying the liquid composition in the liquid composition cartridge 127*a* to the recording head 13. When replacing the ink cartridge 126*a* with a new one, or when the decrease in the print density or the disorder of images occurs due to the kogation even though there is ink remaining in the ink cartridge 126*a,* users can remove the koga or soil deposited on the heater surface by fitting the liquid composition cartridge 127*a,* as a replacement of the ink cartridge 126*a,* onto the recording head 13 to eject the liquid composition of the present invention.

In this case, desirably the cartridge 126*a* for storing recording ink and the cartridge 127*a* for storing the liquid composition have different shapes and sizes so that they can be easily distinguished. Further, mechanical shapes or electrical contact may be provided to the printer body for identifying the liquid composition. Preferably, the liquid composition of the present invention is colored by adding a small amount of a coloring material thereto so that users can know the liquid composition is actually ejected to remove the koga on the heater surface.

In addition, preferably, preliminary auxiliary means are added for the recording head, so that the effect of the present invention is much more stabilized. In particular, capping means or wiping means for the recording head is effective in carrying out a stable ink-jet recording. The present invention is effectively applicable to a full-line type recording head having a length corresponding to the maximum recording width with which the recording apparatus can record on the recording medium. This type of recording head includes, for example, a recording head combining multiple recording heads so as to meet the length and an integrally constituted recording head.

The kind and number of the recording heads mounted in a recording apparatus vary from apparatus to apparatus. For example, only one recording head may be provided corresponding to the monochromatic ink, or multiple recording heads may also be provided corresponding to a plurality of inks different in color or color density. Specifically, the present invention is also highly effective when used for the apparatus provided with at least one of the multiple color recording mode and the full color recording mode by color mixing, by using multiple heads or an integral head, as well as the recording mode with a major recording color, such as black.

The present invention also achieves good results in a recycling business in which used recording heads are collected and regenerated at a recycling plant.

EXAMPLES

The present invention will be described in further detail with reference to the following examples and comparative examples. All the "parts" and "%" used herein mean parts by weight and % by weight unless otherwise specified.

EXAMPLES 1 to 3

The components shown below were mixed, fully stirred and dissolved, then subjected to pressure filtration with a microfilter of 0.2 μm pore size (from Fuji photo Film Co., Ltd.), to prepare liquid compositions (detergents for use in Examples 1 to 3.

| | |
|---|---|
| Components of Liquid Composition of Example 1 | |
| Hydrogen peroxide | 3.3 parts |
| Water | 96.7 parts |
| Components of Liquid Composition of Example 2 | |
| Sodium perborate | 1 part |
| Water | 99 parts |
| Composition of Liquid Composition in Example 3 | |
| 30% Hydrogen peroxide aqueous solution | 6.6 parts |
| 2-propanol | 3 parts |
| Water | 90.4 parts |

Comparative Examples 1 to 2

The components shown below were mixed, fully stirred and dissolved, then subjected to pressure filtration with a microfilter of 0.2 μm pore size (from Fuji Photo Film Co., Ltd.) to prepare liquid compositions (detergents) for use in Comparative Examples 1 to 2.

Components of Liquid Composition in Comparative Example 1

| | |
|---|---|
| Water | 100 parts |

Components of Liquid Composition in Comparative Example 2

| | |
|---|---|
| 2-propanol | 3 parts |
| Water | 97 parts |

<Preparation of Ink for Use in Evaluation Test>

The components shown below were mixed, fully stirred and dissolved, then subjected to pressure filtration with a microfilter of 0.2 μm pore size (from Fuji Photo Film Co., Ltd.) to prepare Ink A for use in the evaluation test.

| Components of Ink A for use in Evaluation test | |
|---|---|
| Projet Fast Black 2 (from Zeneca) | 2.5 parts |
| Glycerol | 5 parts |
| Ethylene glycol | 10 parts |
| 2-propanol | 4 parts |
| Sodium hydroxide | 0.1 parts |
| Water | 78.4 parts |

<Evaluation Test>

Liquid compositions of Examples 1 to 3 and Comparative Examples 1 to 2 and Ink A were evaluated by using an ink-jet recording apparatus equipped with an on-demand type multiple recording head BC-02 (trade name, a product of Canon Inc.). The recording head has a heater of which the uppermost protective layer is made of tantalum and tantalum oxide, and it ejects ink by applying thermal energy to the ink according to recording signals, at drive pulse widths of 1.1 μs (On)+3.0 μs (Off)+3.2 μs (On), a drive voltage of 24.6 V and a drive frequency of 6250 Hz.

The evaluation test was carried out as follows. Continuous ejection of Ink A was performed by using the above apparatus under the above driving conditions, and the liquid droplets ejected from the recording head were collected in a container at every $1\times10^6$ pulses of ejection and weighed by an electronic balance. The average amount of the ejected ink at every $1\times10^6$ pulses of ejection was calculated from the weight increase of the container. The continuous ejection was performed up to $1\times10^8$ pulses.

As a result, the average amount of the ejected ink of from the $9.9\times10^7$ to $1\times10^8$th pulses was about 70% of that of from the 1 to $1\times10^6$th pulses. Then the head was disassembled and the heater surface was observed under an optical microscope (×400) to find a large amount of kogation on the heater.

Next, a cartridge filled with one of the above described liquid compositions of Examples 1 to 3 and Comparative Examples 1 to 2 was connected to a recording head which had been used for the $1\times10^8$ pulses of Ink A, and ejection of the liquid composition was carried out for $5\times10^6$ pulses. After that, the cartridge connected to the above recording head was refilled with the ink A, and $1\times10^6$ pulses of the ink were ejected under the same conditions as above. The average amount of the ejected ink of the 1 to $1\times10^6$ pulses of ejection was measured, and the heater surface of the used nozzle was visually observed under an optical microscope (×400). The evaluation criteria are shown below. The results are shown in Table 1.

<Criteria on Ejection Recovery>

A: The average amount of the ejected droplets is 90% or more of that of the initial 1 to $1\times10^6$ pulses after the cleaning of the heater surface with the liquid composition.

B: The average amount of the ejected droplets is 70–90% of that of the initial 1 to $1\times10^6$ pulses after the cleaning of the heater surface with the liquid composition.

C: The average amount of the ejected droplets is 70% or less of that of the initial 1 to $1\times10^6$ pulses after the cleaning of the heater surface with the liquid composition.

<Criteria on Kogation>

A: Almost no kogation is observed on the heater surface.

B: A small amount of kogation is observed on the heater surface.

C: A large amount of kogation is observed on the heater surface.

TABLE 1

Results

| | Detergent | Recovery of ejection amount | kogation |
|---|---|---|---|
| Example 1 | Hydrogen peroxide | A | A |
| Example 2 | Sodium perborate | A | A |
| Example 3 | Hydrogen peroxide | A | A |
| Comparative Example 1 | None | C | C |
| Comparative Example 2 | None | C | C |

As described above, the present invention can provide a liquid composition capable of cleaning/removing the koga or soil on the heater surface of an ink-jet recording head deposited after long use of the ink-jet recording head or during the manufacturing process thereof, thereby lengthening the life of the ink-jet recording head. The present invention also provides a method of cleaning/removing the koga or soil on the heater surface of an ink-jet recording head to lengthen the life of the ink-jet recording head and an ink-jet recording apparatus. The present invention also provides an ink-jet recording apparatus equipped with means for performing the above method.

What is claimed is:

1. An ink-jet ink decomposition product-removing liquid composition, comprising:

water;

a detergent in an amount effective in cleaning a portion of an ink-jet recording head provided with a heater, the liquid composition generating foam when heated with the heater, wherein the detergent is a compound having oxidizing activity; and wherein the compound having oxidizing activity is at least one selected from the group consisting of hydrogen peroxide, sodium percarbonate, peroxyhydrate of sodium carbonate, sodium perborate, sodium peroxide, sodium periodate, sodium hypochlorite, sodium perchlorate, sodium persulfate and peracetic acid; and a water-soluble aqueous organic solvent.

2. The liquid composition according to claim 1, wherein the organic solvent is selected from the group consisting of methyl alcohol, ethyl alcohol, n-propyl alcohol, isopropyl alcohol, n-butyl alcohol, sec-butyl alcohol, tert-butyl alcohol, isobutyl alcohol, n-pentanol, dimethylformamide, dimethylacetamide, acetone, methyl ethyl ketone, methyl isobutyl ketone, diacetone alcohol, tetrahydrofuran, dioxane, diethylene glycol, triethylene glycol, tetraethylene glycol, dipropylene glycol, tripropylene glycol, polyethylene glycol, polypropylene glycol, ethylene glycol, propylene glycol, trimethylene glycol, triethylene glycol, 1,2,6-hexantriol, glycerol, trimethylolethane, trimethylolpropane, ethyleneglycol monomethyl ether, ethyleneglycol monoethyl ether, diethyleneglycol monomethyl ether, diethyleneglycol monoethyl ether, triethyleneglycol monomethyl ether, triethyleneglycol monoethyl ether, triethyleneglycol dimethyl ether, triethyleneglycol diethyl ether, tetraethyleneglycol dimethyl ether, tetraethyleneglycol diethyl ether, monoethanolamine, diethanolamine, triethanolamine, sulfolane, N-methyl-2-pyrrolidone, 2-pyrrolidone, and 1,3-dimethyl-2-imidazolydinone.

* * * * *

UNITED STATES PATENT AND TRADEMARK OFFICE

CERTIFICATE OF CORRECTION

PATENT NO. : 6,514,920 B1
DATED : February 4, 2003
INVENTOR(S) : Ryuji Katsuragi et al.

It is certified that error appears in the above-identified patent and that said Letters Patent is hereby corrected as shown below:

Title page,
Item [56], References Cited, FOREIGN PATENT DOCUMENTS, "6-220386 8/1993" should read -- 6-220386 8/1994 --.

Column 2,
Line 55, "ink-Jet" should read -- ink-jet --.

Column 4,
Line 63, "Ink-jet" should read -- ink-jet --.

Column 10,
Line 41, "photo" should read -- Photo --.
Line 42, "(detergents" should read -- (detergents) --.

Column 11,
Line 16, "Ink" should read -- Ink A --.

Signed and Sealed this

Twentieth Day of January, 2004

JON W. DUDAS
*Acting Director of the United States Patent and Trademark Office*